US005081558A

United States Patent [19]

Mahler

[11] Patent Number: 5,081,558

[45] Date of Patent: Jan. 14, 1992

[54] HIGH VOLTAGE DC RELAYS

[75] Inventor: Leo M. Mahler, Thousand Oaks, Calif.

[73] Assignee: Northrop Corporation, Hawthorne, Calif.

[21] Appl. No.: 473,806

[22] Filed: Feb. 2, 1990

[51] Int. Cl.[5] ..... H01H 9/30

[52] U.S. Cl. ..... 361/13

[58] Field of Search ..... 361/2-9, 361/13, 131, 133, 159, 160, 170, 206-210; 307/134-137

[56] References Cited

U.S. PATENT DOCUMENTS 3,639,808 2/1972 Ritzow ..... 361/13

4,658,320 4/1987 Hongel ..... 361/13

4,959,746 9/1990 Hongel ..... 361/13

*Primary Examiner*—A. D. Pellinen

*Assistant Examiner*—David Osborn

*Attorney, Agent, or Firm*—Terry J. Anderson; Robert B. Block

[57] ABSTRACT

A high voltage DC relay with arc suppression in which a MOSFET in parallel with the relay contacts is turned on during contact break mode by the controlled discharge of a capacitor between the MOSFET source and drain through a constant current diode to suppress arcing. A sensing coil positioned near the relay coil generates current used to charge the charging capacitor during the make contact mode to suppress arcing.

4 Claims, 1 Drawing Sheet

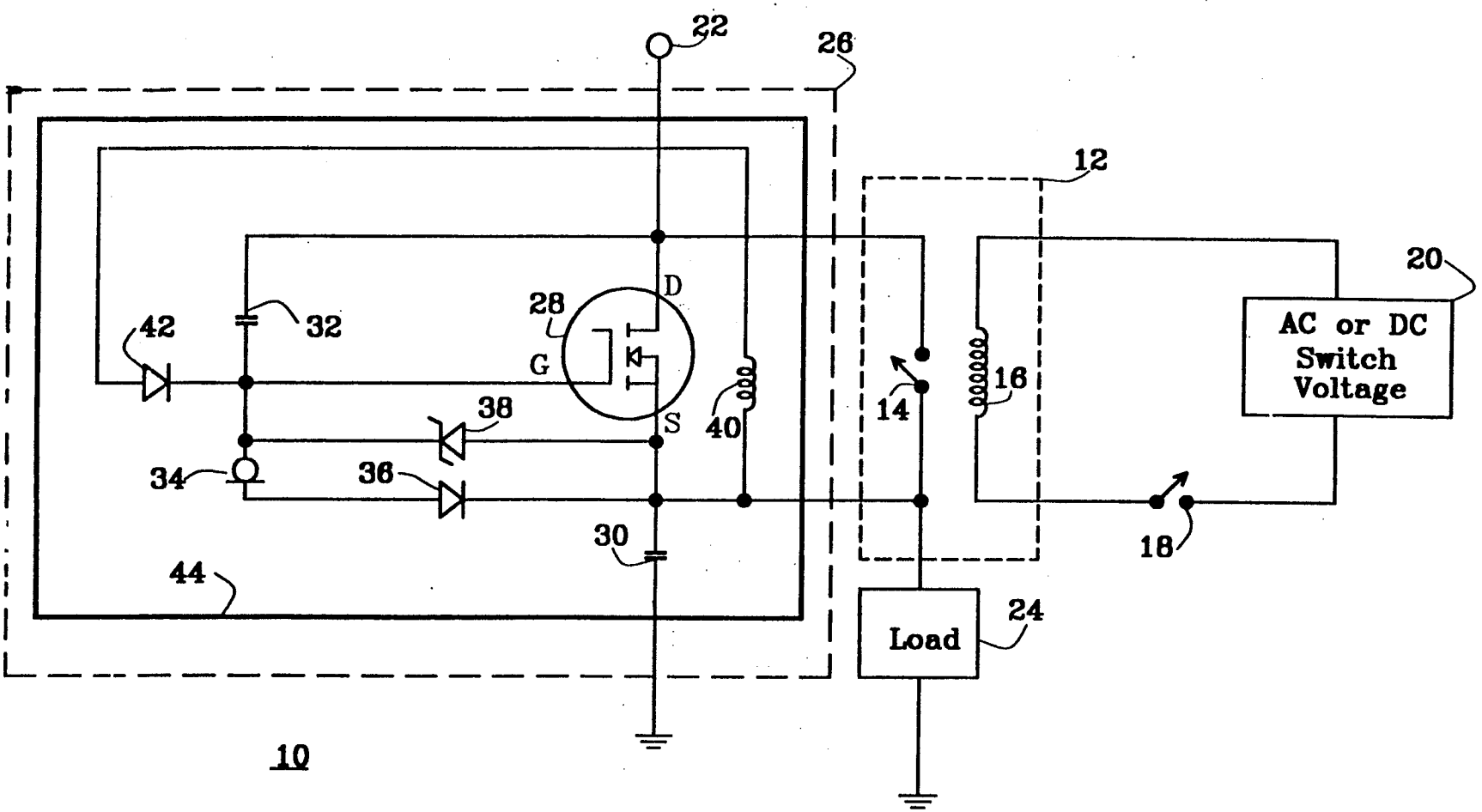
AC or DC Switch Voltage
Load
D
S
G
10
12
14
16
18
20
22
24
26
28
30
32
34
36
38
40
42
44

HIGH VOLTAGE DC RELAYS

CONTRACTUAL ORIGIN OF THE INVENTION

The U.S. Government has rights in this invention pursuant to Contract No. F33657-81-C2123 awarded by the United States Air Force.

BACKGROUND OF THE INVENTION

1. Field of the Invention

This invention relates to high voltage DC relays and in particular relates to arc suppression for such relays 2. Description of the Prior Art Conventional DC relays are limited to operating voltages of about 28 volts because at higher DC voltages, the air molecules tend to ionize and cause arcing during the making or breaking contact modes Conventional high voltage DC relays place the relay contacts in vacuum or in an inert gas to suppress arcing.

SUMMARY OF THE INVENTION

The preceding and other shortcomings of the prior art are addressed and overcome by the present invention that provides a high voltage DC relay of the type having a coil which actuates relay contacts in series between a source of DC voltage and a load and the improvement includes a MOSFET semiconductor transistor device having source and drain in parallel with the relay contacts, a load capacitor in parallel with the load, a charging capacitor between the MOSFET drain and gate, and means for discharging the charging capacitor through the load and load capacitor at a controlled rate to maintain the MOSFET conducting during the contact break mode to suppress arcing.

In another aspect, the present invention provides a method suppressing arcing in a high voltage DC relay including the steps of connecting a MOSFET semiconductor transistor device source and drain in parallel with the relay contacts, charging a load capacitor in parallel with the load, discharging a charging capacitor through the load and load capacitor at a controlled rate to maintain the MOSFET conducting during the contact break mode to suppress arcing.

These and other features and advantages of this invention will become further apparent from the detailed description that follows which is accompanied by a drawing figure. In the figure and description, numerals indicate the various features of the invention, like numerals referring to like features throughout both the drawing and the description.

BRIEF DESCRIPTION OF THE DRAWING

The Figure is a schematic representation of a high voltage DC relay with arc suppression according to the present invention.

DETAILED DESCRIPTION OF THE PREFERRED EMBODIMENT(s)

The Figure is a schematic representation of high voltage DC relay lo with arc suppression according to the present invention. Relay module 12 includes relay contacts 14 in contact with the ambient atmosphere. Relay contacts 14 may be normally open or normally closed. For convenience, normally open contacts will be described. Normally open relay contacts 14 are actuated, and therefore closed to make contact, in response to current flowing through relay coil 16. The system as described so far is similar to conventional DC relays in which arcing may occur during both the make and break contact modes.

In accordance with the present invention, arc suppression circuitry 26 is applied across relay contacts 14 to suppress arcing. The operation of arc suppression circuitry 26 during the contact break mode to suppress arcing will be described first. When relay actuation switch 18 is closed, current from AC or DC switch voltage supply 20 is applied to relay coil 16 to close relay contacts 14 and apply DC power from DC power supply 22 to load 24. Load capacitor 30 is applied in parallel with load 24 and is therefore set to the same voltage as load 24. MOSFET 28 is connected with the source and drain in parallel with relay contacts 14. MOSFET 28 is turned on to conduct, but conducts essentially no current because it is effectively short-circuited by relay contacts 14.

However, when relay actuation switch is is opened, relay contacts 14 begin to break contact. In a conventional relay system without arc suppression, the arcing would begin as relay contacts 14 begin to break contact. In accordance with the present invention, MOSFET 28 is still turned on and continues to conduct while charging capacitor 32, connected between MOSFET gate and drain, begins to bleed off the DC voltage through constant current diode 34. The on time during which MOSFET 28 remains fully conducting is about 3 milliseconds and is controlled by the values of charging capacitor 32 and constant current diode 34.

Diode 36 is used to block induction spikes from load 24 while 15 volt Zener diode 38 limits the gate to source voltage across MOSFET 28. In this manner, during the break contact mode, potential arcing is suppressed because MOSFET 28 shorts circuits relay contacts 14 for about 3 milliseconds when relay actuation switch 18 is opened.

Arc suppression during the make contact mode will be described next and is accomplished by the addition of coil 40 and diode 42. When relay actuation switch 18 is closed, the current through relay coil 16 induces a current through coil 40 which is first rectified by diode 42 and then applied across charging capacitor 32 to charge it. The voltage across charging capacitor 32 turns on MOSFET 28 to permit MOSFET 28 to conduct for a short time while relay contacts 14 are closing and minimize arcing. Very little current is required to charge charging capacitor 32 and turn on MOSFET 28 so that the wire windings used on coil 40 may be very small in diameter permitting coil 40 to be very small in size.

It is important to note that very little power is dissipated by MOSFET 28 during the short time it is conducting current during the make contact and break contact modes of operation of high voltage DC relay 10, very little heat is generated so that the components utilized in high voltage DC relay 10 may be incorporated in an integrated circuit or other small housing and mounted directly on relay frame heat sink 44 or other structure associated with high voltage DC relay 10. Relay frame heat sink 44 may be used as a heat sink and conveniently be configured as part of the frame of relay module 12.

While this invention has been described with reference to its presently preferred embodiment(s), its scope is not limited thereto. Rather, such scope is only limited insofar as defined by the following set of claims and all equivalents thereof.

What is claimed is:

1. An arc suppression relay circuit for connecting a power source to load, comprising:

a relay having a pair of contacts and a coil for operating the relay contacts between open and closed positions for applying power to said load;

a MOSFET having a source, ad rain, and a gate;

means connecting said source and drain across said contacts respectively; p1 a sensing coil positioned in coupled relation to said relay coil and having one end directly connected to a conductor between said relay contacts and said load;

a diode connected from the other end of said sensing coil to said gate of said MOSFET;

a capacitor having one end connected to said gate and another end connected to said drain;

means for controllably discharging said capacitor at a predetermined rate;

whereby when said relay coil is operated to make or break said contacts, the sensing coil turns said MOSFET into a conducting state for a time dependent on said capacitor and discharge means so that said MOSFET, while conductive, serves to short said contacts as they make or break to prevent arc breakdown.

2. The relay circuit claimed in claim 1 wherein the discharging means includes a constant current diode connected between said MOSFET gate and source.

3. The relay circuit claimed in claim 2 wherein the discharging means further comprises:

a second diode in series with the constant current diode to block induction spikes from the load during the contact break mode.

4. The relay circuit claimed in claim 2 further comprising:

a Zener diode between the MOSFET gate and source to limit the gate to source voltage applied thereto.

* * * * *